United States Patent [19]

Staerzl

[11] 4,401,085

[45] Aug. 30, 1983

[54] SHUT DOWN PROTECTION APPARATUS FOR A WATER COOLED INTERNAL COMBUSTION ENGINE

[75] Inventor: Richard E. Staerzl, Fond du Lac, Wis.

[73] Assignee: Brunswick Corporation, Skokie, Ill.

[21] Appl. No.: 329,991

[22] Filed: Dec. 11, 1981

[51] Int. Cl.[3] ..... F02M 51/00

[52] U.S. Cl. ..... 123/488; 123/41.15

[58] Field of Search ..... 123/41.31, 41.35, 41.55, 123/325, 326, 493, 488, 198 DC

[56] References Cited

U.S. PATENT DOCUMENTS

| | | | |
|---|---|---|---|
| 4,008,696 | 2/1977 | Hisatomi | 123/326 |
| 4,311,123 | 1/1982 | Glöckler et al. | 123/325 |
| 4,327,682 | 5/1982 | Harada | 123/326 |

*Primary Examiner*—William A. Cuchlinski, Jr.
*Attorney, Agent, or Firm*—Hopgood, Calimafde, Kalil, Blaustein & Judlowe

[57] ABSTRACT

The invention contemplates engine shut down protection apparatus used in conjunction with an electronic fuel injection circuit for a water cooled internal-combustion engine. When turning off water-cooled internal combustion engines equipped with typical electronic fuel injection systems both the fuel supply and the ignition circuit are disabled. As the engine speed decreases the engine block cools faster than the pistons since the block is water cooled and this uneven cooling may result in damage when the engine is shut down at high speed. The instant invention maintains the fuel supply to the pistons after engine shut down to cool and lubricate the pistons and prevent possible engine damage.

8 Claims, 4 Drawing Figures

SHUT DOWN PROTECTION APPARATUS FOR A WATER COOLED INTERNAL COMBUSTION ENGINE

BACKGROUND OF THE INVENTION

This invention relates to shut down protection apparatus used in conjunction with an electronic fuel-injection control circuit for a water-cooled internal-combustion engine of the type described in my copending U.S. patent application Ser. No. 120,467 filed Feb. 11, 1980 and my U.S. Pat. No. 4,280,465 issued July 28, 1981. Reference is made to said application and to said United States Patent for greater descriptive detail of a fuel injection engine, to which the present invention is illustratively applicable. Although the internal combustion engines discussed in said application Ser. No. 120,467 and said U.S. Pat. No. 4,280,465 are not specifically shown as being water cooled it is understood that the manner in which said marine outboard engines are water cooled is well known and thus the specific manner of cooling will not be discussed herein.

In fuel injection control circuits of the character indicated both the ignition circuit and the fuel supply are normally turned off at engine shut down. With water-cooled engines the engine block will cool down faster than the pistons, resulting in uneven cooling between the pistons and the engine block. Such uneven cooling can cause damage when the engine is shut down and is especially detrimental when the engine is turned off while running at high speed.

BRIEF STATEMENT OF THE INVENTION

It is a general object of the invention to provide shut down protection apparatus for a water-cooled fuel-injection internal combustion engine.

Another object of the invention is to prevent uneven cooling of the engine block and engine pistons when a water-cooled internal combustion engine is shut-off.

A further object of the invention is to maintain the fuel flow to a water-cooled internal combustion engine for a predetermined interval after the engine is shut off.

A still further object of the invention is to disable the ignition circuit upon engine shut down of a water-cooled internal combustion engine while gradually decreasing the fuel supply to ensure that the engine pistons are cooled at the same rate as the engine block.

Still another object is to achieve the above objects with generally uncomplicated circuitry adaptable to the fuel-mixture requirements of a variety of sizes, styles and uses of different water cooled fuel-injected internal combustion engines.

The invention achieves the foregoing objects and certain further features by utilizing a comparator circuit which compares the amplitude of a tachometer signal with a bias voltage impressed on a leaky storage device. When the engine is shut down the amplitude of the tachometer signal decreases below the level of the charge on the storage device and this condition enables a continuous and gradually decreasing fuel supply to the pistons of internal combustion engine to cool and lubricate the pistons as the engine slows down. The supply of additional fuel continues for a predetermined interval based on the level of charge on the leaky storage device.

DETAILED DESCRIPTION

The invention will be described in detail, in conjunction with the accompanying drawings in which.

Figure 1:
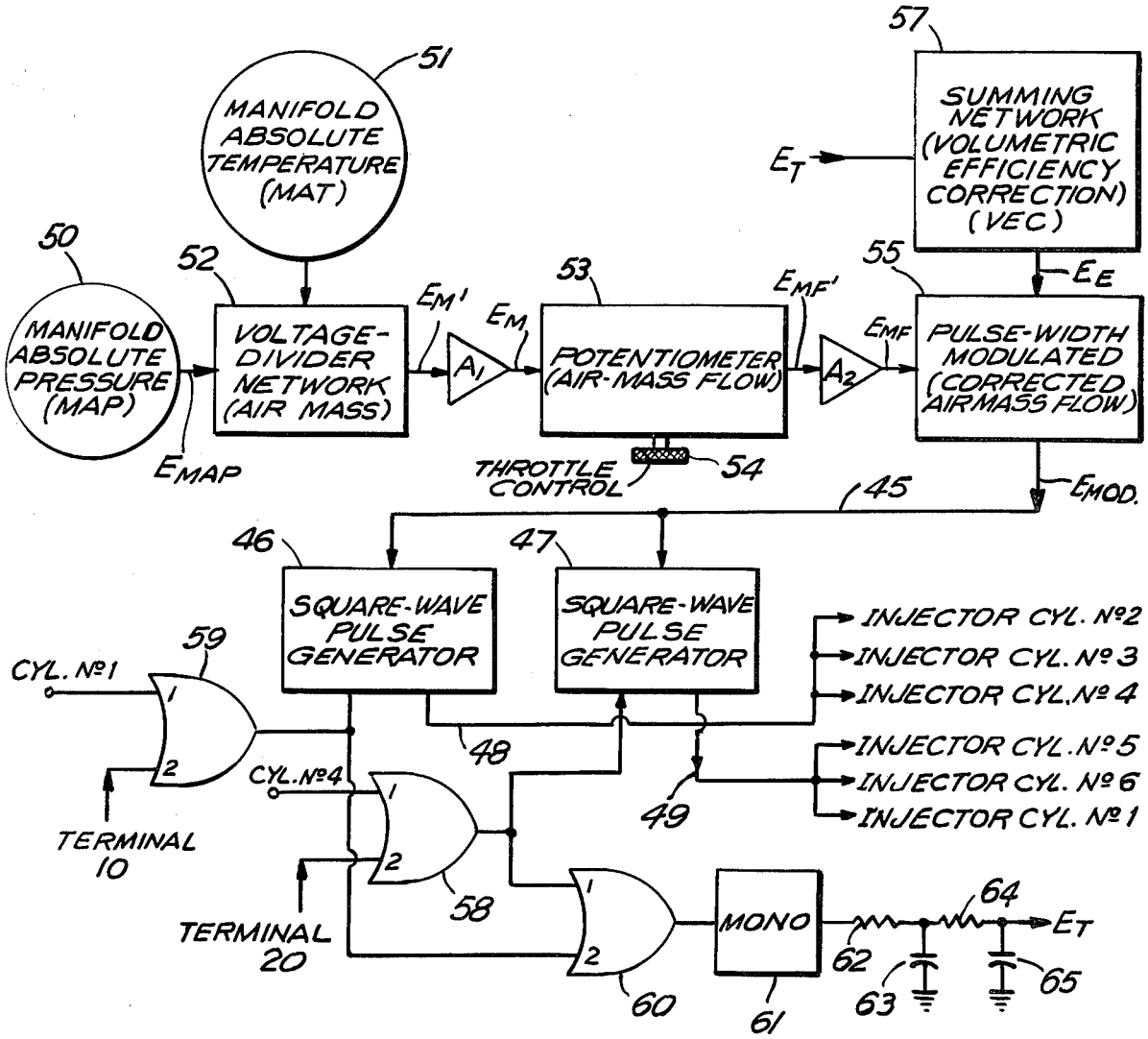
FIG. 1 is a diagram schematically showing components of an electronic fuel-injection control system for an internal combustion engine.

In my issued U.S. Pat. No. 4,280,465, a fuel-injection control circuit is described in which one or more square-wave pulse generators drive solenoid-operated injectors unique to each cylinder, there being a single control system whereby the pulse generator means is modulated as necessary to accommodate throttle demands in the context of engine speed and other factors. FIG. 1 herein, modified in accordance with the following description, is adopted from said U.S. Patent for purposes of simplified contextual explanation.

The control system of FIG. 1 is shown in illustrative application to a water-cooled two-cycle six-cylinder 60-degree V-engine wherein injectors (not shown) for cylinders #2, #3 and #4 are operated simultaneously and (via line 48) under the control of the pulse output of a first square-wave generator 46, while the remaining injectors (not shown) (for cylinders #5, #6 and #1 ) are operated simultaneously and (via line 49) under the control of the pulse output of a second such generator 47. The base or crankshaft angle for which pulses generated at 46 are timed is determined by ignition-firing at cylinder #1, and pulses generated at 47 are similary based upon ignition-firing at cylinder #4, i.e., at 180 crankshaft degrees from cylinder #1 firing. The ignition triggers from cylinder #1 and cylinder #4 are applied to the square-wave pulse generators via OR gates 58 and 59, it being understood that a voltage divider network (not shown) would be necessary to reduce the trigger voltages to a level compatable with the logic level of OR gates 58 and 59. The actual time duration of the pulses generated by the square-wave generators will vary in response to the amplitude of a control signal ($E_{MOD}$), supplied in line 45 to both generators 46–47 with a greater amplitude resulting in a pulse of greater duration.

The circuit to produce the modulating-voltage $E_{MOD}$. operates on various input parameters, in the form of analog voltages which reflect air-mass flow for the current engine speed, and a correction is made for volumetric efficiency of the particular engine. More specifically, for the circuit shown, a first electrical sensor 50 of manifold absolute pressure is a source of a first voltage $E_{MAP}$ which is linearly related to such pressure, and a second electrical sensor 51 of manifold absolute temperature may be a thermistor which is linearly related to such temperature through a resistor network 52. The voltage $E_{MAP}$ is divided by the network 52 to produce an output voltage $E_M'$, which is a linear function of instantaneous air mass or density at inlet of air to the engine. A first amplifier Al provides a corresponding output voltage $E_M$ at the high-impedance level needed for regulation-free application to the relatively low impedance of the potentiometer means 53, having a selectively variable control that is symbolized by a throttle knob 54. The voltage output $E_{MF}'$, of potentiometer means 53, reflects a "throttle"—positioned pickoff voltage and reflects instantaneous air-mass flow, for the instantaneous throttle (54) setting, and a second amplifier A2 provides a corresponding output voltage $E_{MF}$ for regulation-free application to one of the voltage-multiplier inputs of a pulse-width modulator 55, which is the source of $E_{MOD}$ already referred to.

The other voltage-multiplier input of modulator 55 receives an input voltage $E_E$ which is a function of engine speed and volumetric efficiency. More specifically, monostable multivibrator 61 generates a square-wave pulse each time a trigger signal from cylinder #1 or cylinder #4 is applied thereto via OR gates 58–60. The output of the multivibrator is applied to a filter network consisting of resistors 62, 64 and capacitors 63, 65 and at the output of the filter network there is a voltage signal $E_T$ which is linearly related to engine speed (e.g. repetition rate of the spark plug firing) and functions as a tachometer signal for application to summing network 57. Summing network 57 operates upon the voltage $E_T$ and certain other factors (which may be empirically determined and which reflect volumetric efficiency of the particular engine size and design) to develop the voltage $E_E$ for the multiplier of modulator 55. It is to be understood that although the fuel injection control circuit of FIG. 1 has been illustrated in connection with a two-cycle engine, the same circuit can be used in conjunction with a four-cycle engine.

Figure 2:
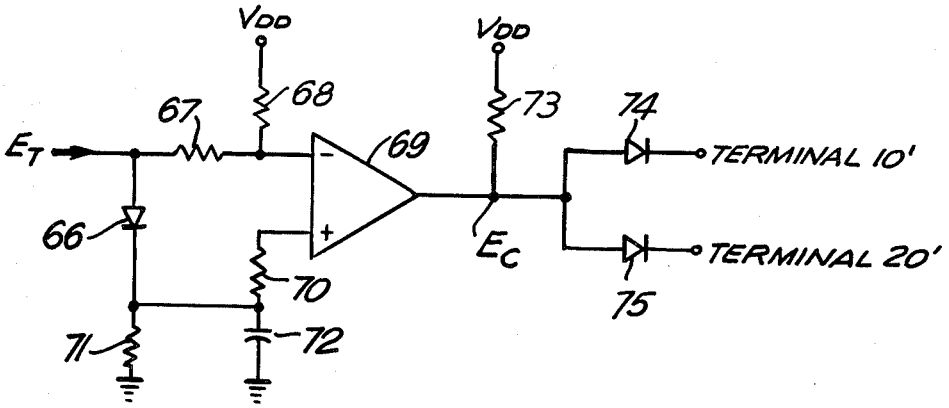
FIG. 2 is a diagram schematically showing the engine shut down protection circuit of the instant invention, and FIGS. 3A and 3B illusrate various wave forms present in the circuit of FIG. 2.

The present invention is concerned with the nature and performance of the engine shut down protection circuit illustrated in FIG. 2. Water cooled marine engines of the type applicable to the present invention normally have both the ignition circuit and the fuel supply disabled upon engine shut down. Since the engine block continues to be water cooled as the engine speed decreases the engine block cools faster than the pistons. This is not a problem when the engine is shut down at comparatively low speeds, e.g. less than 2,000 rpm, but such uneven cooling may cause engine damage when the engine is shut down at high speeds, e.g. 2,000 to 9,000 rpm. The circuit of FIG. 2 solves this problem by continuing to supply fuel to the pistons for a predetermined interval after the engine is turned off to cool and lubricate the pistons, thus eliminating the problem of uneven cooling and preventing any possible engine damage.

More specifically comparator 69 has applied thereto the tachometer signal $E_T$ generated by monostable multivibrator 61 and filtered by the network consisting of resistors 62, 64 and capacitors 63, 65. This signal is applied to the "−" input terminal of comparator 69 via resistor 67 where it is summed with a bias voltage equal to supply voltage VDD minus the voltage drop across resistor 68. The tachometer signal also charges capacitor 72 (leaky storage device) via diode 66 to a level dependent on the frequency of the tachometer signal which of course is directly dependent on engine speed. At high engine speeds, approximately 5,000 rpm. capacitor 72 will charge to a level of approximately 2 volts and at lower engine speeds, approximately 2,000 rpm, the capacitor charges to a level of approximately one volt. Resistor 71 provides a discharge path for capacitor 72. The output of comparator 69, signal $E_C$ is applied to OR gates 58 and 59 via diodes 74 and 75 and terminals 10, 10' and 20, 20'.

Figure 3A:
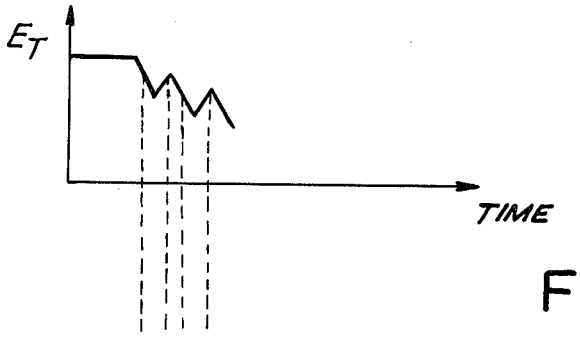
Figure 3B:
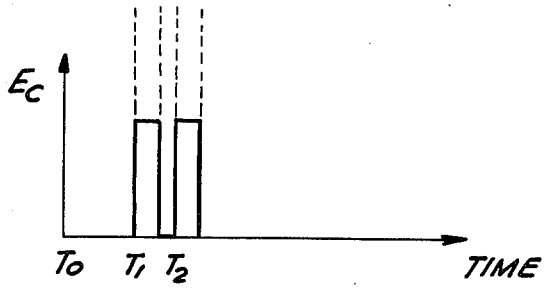

Referring now to FIGS. 3A and 3B, and assuming an engine speed of approximately 5,000 rpm. voltage $E_T$, when summed with the bias voltage present at the "−" terminal of comparator 69 is greater in value than the voltage across capacitor 72 and present at the "+" terminal of comparator 69. Under these conditions the output of comparator 69, voltage $E_C$, is low as illustrated in FIG. 3B at time $T_O$. Assume that the associated internal combustion engine is shut down, causing a sharp drop in tachometer voltage as illustrated in FIG. 3A. As the tachometer voltage falls the voltage present at the "−" terminal of comparator 69 will also fall until it is less than the voltage present at the "+" terminal of the comparator. When this occurs, as illustrated in FIGS. 3A and 3B at time $T_l$, the output of comparator 69 goes high applying signal $E_C$ to OR gates 58 and 59 via diodes 74 and 75 and from there to square wave pulse generators 46 and 47 and monostable multivibrator 61. Application of signal $E_C$ to the square wave pulse generator results in generation of an injector pulse which, as described above, applies fuel to the pistons in the associated internal combustion engine.

Application of signal $E_C$ to monostable multivibrator 61 reactivates the tachometer signal $E_T$ which causes this signal to increase in amplitude as shown in FIG. 3A. When $E_T$, as summed with the bias voltage at the "−" terminal of comparator 69 again exceeds the voltage at the "+" terminal of comparator 69 the output of the comparator again goes low, as shown in FIG. 3B, causing a second decline in signal $E_T$. When the voltage at the "−" terminal of comparator 69 again falls below the voltage at the "+" terminal the output of the comparator again goes high, as shown at time $T_2$ in FIG. 3B, causing additional activation of the square wave pulse generators, the supply of additional fuel to the pistons and reactivation of the tachometer signal $E_T$. This process will continue with the amplitude of signal $E_T$ gradually declining as shown in FIG. 3A due to the declining charge level in capacitor 72 until the bias voltage at the "−" input terminal of the comparator is consistently greater than the voltage across capacitor 72 and present at the "+" terminal of the comparator. At this point the process is completed and additional fuel is no longer supplied to the pistons. At 9,000 rpm the process just described takes approximately $1\frac{1}{2}$ to 2 seconds while at 4,000 rpm the process is completed in approximately $\frac{1}{2}$ second.

The supply of additional fuel during engine shut down only occurs when the engine is turned off when running in excess of approximately 2,000 rpm. As discussed above, at 2,000 rpm, the charge level on capacitor 72 is equal to approximately one volt and this level is less than the bias voltage present on the "−" input terminal of comparator 69 ensuring that the output of the comparator remains low. This threshold level can of course be varied by simply altering the discharge rate of capacitor 72 via resistor 71 or by changing the bias voltage present at the "−" input terminal of the comparator.

The described invention will be seen to meet the stated objectives of providing fuel to the pistons of a water cooled internal combustion engine for a predetermined interval of time after the engine has been turned off. The supply of fuel cools and lubricates the pistons as the engine stops thus preventing possible engine damages resulting from unequal cooling between the pistons and the water cooled engine block.

While the invention has been described in detail for preffered and illustrative embodiments, it will be understood that modifications may be made without departure from the claimed scope of the invention.

What is claimed is:

1. In an electronic fuel-injection control circuit for a water cooled internal-combustion engine wherein a square-wave pulse generator provides output signals of variable duration, said output signals controlling the fuel flow rate to pistons of said water cooled internal combustion engine, the improvement comprising, means for detecting engine shut down and means responsive to said detecting means for maintaining the generation of said output signals from said square wave pulse generators for a predetermined interval of time after said engine shut down whereby fuel continues to be supplied to the pistons of said internal combustion engine after engine shut down.

2. In an electronic fuel-injection control circuit in accordance with claim 1 wherein the duration of said predetermined interval of time is dependent upon engine speed at shut down.

3. In an electronic fuel-injection control circuit in accordance with claim 2 wherein said maintaining means is operative only when said engine speed at shut down exceeds a predetermined value.

4. In an electronic fuel-injection control circuit for a water cooled internal combustion engine wherein means are provided for controlling the fuel flow rate to pistons of said internal combustion engine, the improvement comprising, means for generating a tachmometer signal representative of engine speed and for applying said tachometer signal to a leaky storage device, the tachometer signal amplitude impressed upon said leaky storage device being dependent on engine speed, means for comparing the tachometer signal amplitude impressed upon said leaky storage device with a bias signal of a predetermined amplitude, and means responsive to said comparing means for enabling said controlling means to continue to supply fuel to the pistons of said internal combustion engine for a pre-determined interval of time subsequent to the time said interval combustion engine is shut down when the amplitude of said bias signal is less than the tachometer signal amplitude impressed upon said leaky storage device.

5. In an electronic fuel-injection control circuit in accordance with claim 4 wherein said enabling means do not enable said controlling means subsequent to engine shut down when the amplitude of said bias signal is greater than the tachometer signal amplitude impressed upon said leaky storage device.

6. In an electronic fuel-injection control circuit in accordance with claim 4 wherein the duration of said predetermined interval of time is dependent upon engine speed at engine shut down.

7. In an electronic fuel injection control circuit in accordance with claim 6 wherein said predetermined interval of time is equal to approximately $1\frac{1}{2}$ seconds at an engine speed of 9,000 rpm and equal to approximately $\frac{1}{2}$ seconds at an engine speed of 4,000 rpm.

8. In an electronic fuel injection control circuit in accordance with claim 4 wherein said enabling means do not enable said controlling means subsequent to engine shut down when engine speed at shut down is less than approximately 2,000 rpm.

* * * * *